US011826292B1

(12) United States Patent
Paek

(10) Patent No.: US 11,826,292 B1
(45) Date of Patent: Nov. 28, 2023

(54) BACKREST INTERLOCKING TYPE FRAME FOR FOLDABLE WHEELCHAIR

(71) Applicant: Seong Hyun Paek, Gwangju-si (KR)

(72) Inventor: Seong Hyun Paek, Gwangju-si (KR)

( * ) Notice: Subject to any disclaimer, the term of this patent is extended or adjusted under 35 U.S.C. 154(b) by 0 days.

(21) Appl. No.: 17/963,488

(22) Filed: Oct. 11, 2022

(30) Foreign Application Priority Data

Jun. 10, 2022 (KR) ..... 10-2022-0070548

(51) Int. Cl.
*A61G 5/00* (2006.01)
*A61G 5/08* (2006.01)

(52) U.S. Cl.
CPC ..... *A61G 5/0866* (2016.11); *A61G 5/0825* (2016.11)

(58) Field of Classification Search
CPC .. A61G 5/0866; A61G 5/0825; A61G 5/0833; A61G 5/085; A61G 5/00
USPC ..... 280/650
See application file for complete search history.

(56) References Cited

U.S. PATENT DOCUMENTS 9,375,370 B2 * 6/2016 Horacek ..... A61G 5/1054
11,554,059 B2 * 1/2023 Cohen Gazit ..... A61G 5/0825
2003/0006578 A1 * 1/2003 Melgarejo ..... A61G 5/08 280/250.1
2006/0145456 A1 * 7/2006 Munsey ..... A61G 5/1054 280/649
2016/0058637 A1 * 3/2016 Horacek ..... A61G 5/1054 280/649
2021/0236356 A1 * 8/2021 Cohen Gazit ..... A61G 5/121

* cited by examiner

*Primary Examiner* — James A Shriver, II
*Assistant Examiner* — Hilary L Johns
(74) *Attorney, Agent, or Firm* — John K. Park; PARK LAW FIRM

(57) ABSTRACT

Disclosed herein is a backrest interlocking type frame for a foldable wheelchair. The backrest interlocking type frame includes: a seat frame which includes a first horizontal bar and a second horizontal bar spaced apart from each other at a predetermined interval and arranged at the top and the bottom of the seat frame, a first mounting member, a second mounting member, and a third mounting member mounted between the first horizontal bar and the second horizontal bar to be spaced apart from one another, a first bracket mounted on the first mounting member and a second bracket mounted on the second mounting member; a backrest frame which includes a first vertical bar and a second vertical bar formed integrally, wherein one end of the first vertical bar is rotatably mounted on the third mounting member of the seat frame through a first hinge portion, and both ends of a rail are fixed between the second mounting member and the third mounting member of the seat frame; a horizontally foldable frame rotatably mounted on the first bracket and the second bracket of the seat frame; and a transfer block mounted on the rail to move along the rail, wherein one end of a retractor is rotatably mounted on the transfer block through a third hinge portion, the other end of the retractor is rotatably mounted on the second vertical bar of the backrest frame through a second hinge portion, so that the horizontally foldable frame is operated to be folded when the backrest frame is folded downwardly, thereby reducing the overall width of the seat frame.

1 Claim, 9 Drawing Sheets

BACKREST INTERLOCKING TYPE FRAME FOR FOLDABLE WHEELCHAIR

BACKGROUND OF THE INVENTION

Field of the Invention

The present invention relates to a frame for a foldable wheelchair, and more particularly, to a backrest interlocking type frame for a foldable wheelchair capable of simultaneously folding the overall height and width to minimize a volume when not being used.

Background Art

In general, a wheelchair is a chair having wheels to help a person who has a problem with the leg or the old or the weak to move while sitting on the wheelchair, and is a short-distance moving means which is used for the old, the weak or the handicapped in work life, home life, and leisure life.

Accordingly, in order to reduce the volume of the wheelchair in a situation in which the wheelchair used for a short-range moving means must be moved to a long distance or to a certain place such as a house at a long distance, a foldable wheelchair has been proposed.

A general folding structure of a manual or automatic wheelchair is divided into a method of narrowing a width and a method of narrowing a depth to provide convenience. However, recently, technique for providing handicapped users with better satisfaction in use by reducing weight and volume of a frame has been proposed.

PATENT LITERATURE

Patent Documents

Patent Document 1: Korean Patent No. 10-0881899 (Feb. 11, 2009)

SUMMARY OF THE INVENTION

Accordingly, the present invention has been made to solve the above-mentioned problems occurring in the prior arts, and it is an object of the present invention to provide a backrest interlocking type frame for a foldable wheelchair, in which a folding structure of a foldable wheelchair is improved to provide better satisfaction to a user, and to minimize the volume by folding the overall height and width of the wheelchair when a backrest frame is operated.

To accomplish the above object, according to the present invention, there is provided a backrest interlocking type frame for a foldable wheelchair including: a seat frame which includes a first horizontal bar and a second horizontal bar spaced apart from each other at a predetermined interval and arranged at the top and the bottom of the seat frame, a first mounting member, a second mounting member, and a third mounting member mounted between the first horizontal bar and the second horizontal bar to be spaced apart from one another, a first bracket mounted on the first mounting member and a second bracket mounted on the second mounting member; a backrest frame which includes a first vertical bar and a second vertical bar formed integrally, wherein one end of the first vertical bar is rotatably mounted on the third mounting member of the seat frame through a first hinge portion, and both ends of a rail are fixed between the second mounting member and the third mounting member of the seat frame; a horizontally foldable frame rotatably mounted on the first bracket and the second bracket of the seat frame; and a transfer block mounted on the rail to move along the rail, wherein one end of a retractor is rotatably mounted on the transfer block through a third hinge portion, the other end of the retractor is rotatably mounted on the second vertical bar of the backrest frame through a second hinge portion, so that the horizontally foldable frame is operated to be folded when the backrest frame is folded downwardly, thereby reducing the overall width of the seat frame.

The backrest interlocking type frame for a foldable wheelchair according to the present invention can simultaneously reduce the overall height and the overall width by just one motion to fold a backrest frame when the wheelchair is not used, so that the overall volume of the wheelchair is remarkably reduced, thereby allowing a user to easily load and store the wheelchair.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, technical configuration and effects of preferred embodiments of the present invention capable of achieving the objects of the present invention will be described in comparison with problems of the conventional art. In a case in which it is determined that detailed description of well-known features and configurations according to the present invention does not conform with the gist of the present invention, the detailed description will be omitted.

Figure 1:
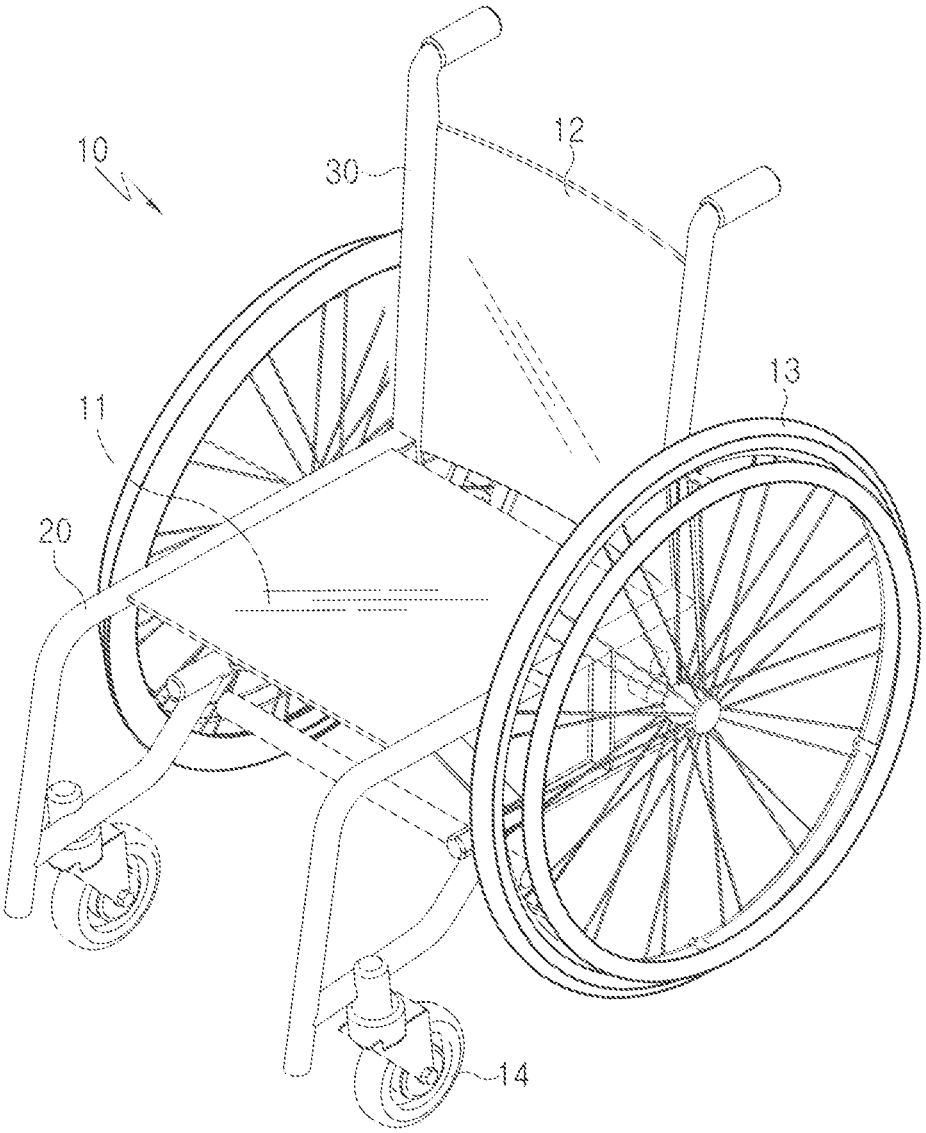
FIG. 1 is a perspective view illustrating problems of a conventional foldable wheelchair.
Figure 2:
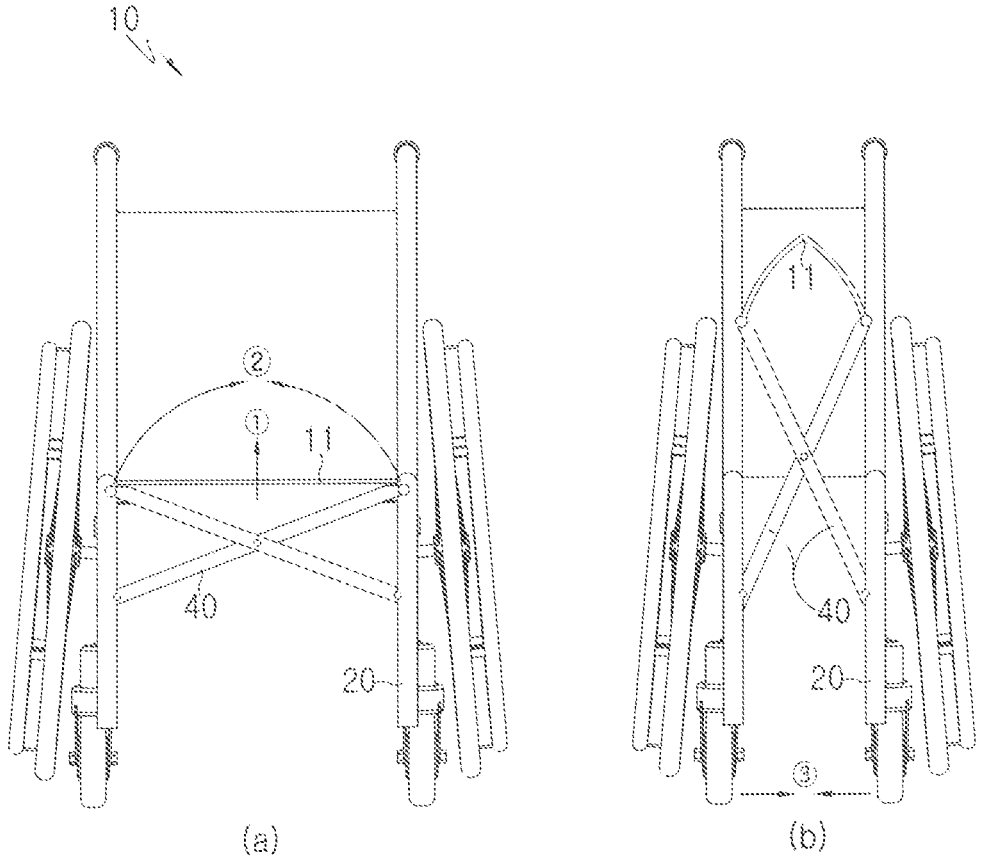
FIG. 2 is a front view illustrating the problems of the conventional foldable wheelchair.

FIG. 1 is a perspective view illustrating problems of a conventional foldable wheelchair, and FIG. 2 is a front view illustrating the problems of the conventional foldable wheelchair.

The wheelchair illustrated in FIG. 1 is a manual wheelchair which includes a backrest frame 30 on which a backrest 12 capable of being easily folded is mounted and a seat frame 20 on which a foldable seat 11 is mounted, wherein drive wheels 13 are mounted on both sides of the seat frame 20, and small driven wheels 14 are mounted on the front side of the seat frame 20, so that a user can drive while rolling the drive wheels 13 with the hand.

Considering that the wheelchair is a short-range moving means used for in work life, home life, and leisure life, it is necessary to fold the wheelchair in order to reduce the volume of the wheelchair in a situation in which the wheelchair moves a long distance or moves to a certain place such as a house.

FIG. 2(*a*) is a front view of the wheelchair. A user can fold the wheelchair 10 in such a way that a vertically foldable frame 40 located beneath the foldable seat 11 and having an X-shaped structure according to a foldable link method is lifted up.

That is, when the user lifts the foldable seat 11 like the arrow ① illustrated in FIG. 2A or releases the vertically foldable frame 40 seated on the seat frame 20 to rotate as indicated by the arrow ②, as illustrated in FIG. 2(*b*), the vertically foldable frame 40 is lifted up and the horizontal width of the wheelchair becomes narrow as indicated by the arrow ③, thereby folding the wheelchair.

However, there is a structural problem of the wheelchair 10 to which the conventional vertically foldable frame 40 is applied. As illustrated in FIG. 2(*b*), a side height is added due to the vertically foldable frame 40 lifted up in the folded state, and so, the reduction of volume is insignificant in substance.

Moreover, when the wheelchair is loaded on a trunk of a vehicle, there is a structural problem that it is inconvenient to stack other objects on the wheelchair due to the newly added side height of the vertically foldable frame 40.

Figure 3:
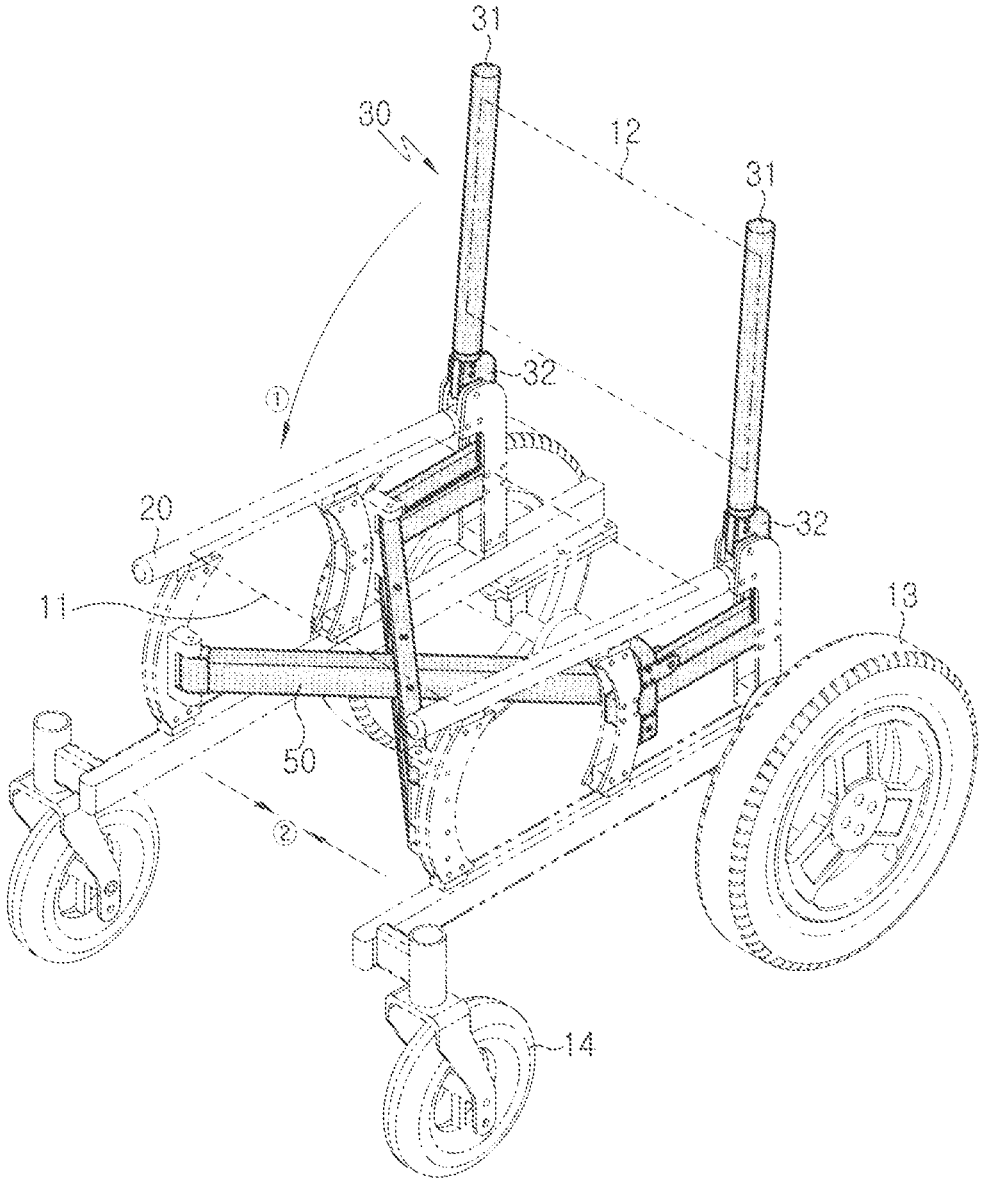
FIG. 3 is a perspective view of a backrest interlocking type frame for a foldable wheelchair according to the present invention.
Figure 4:
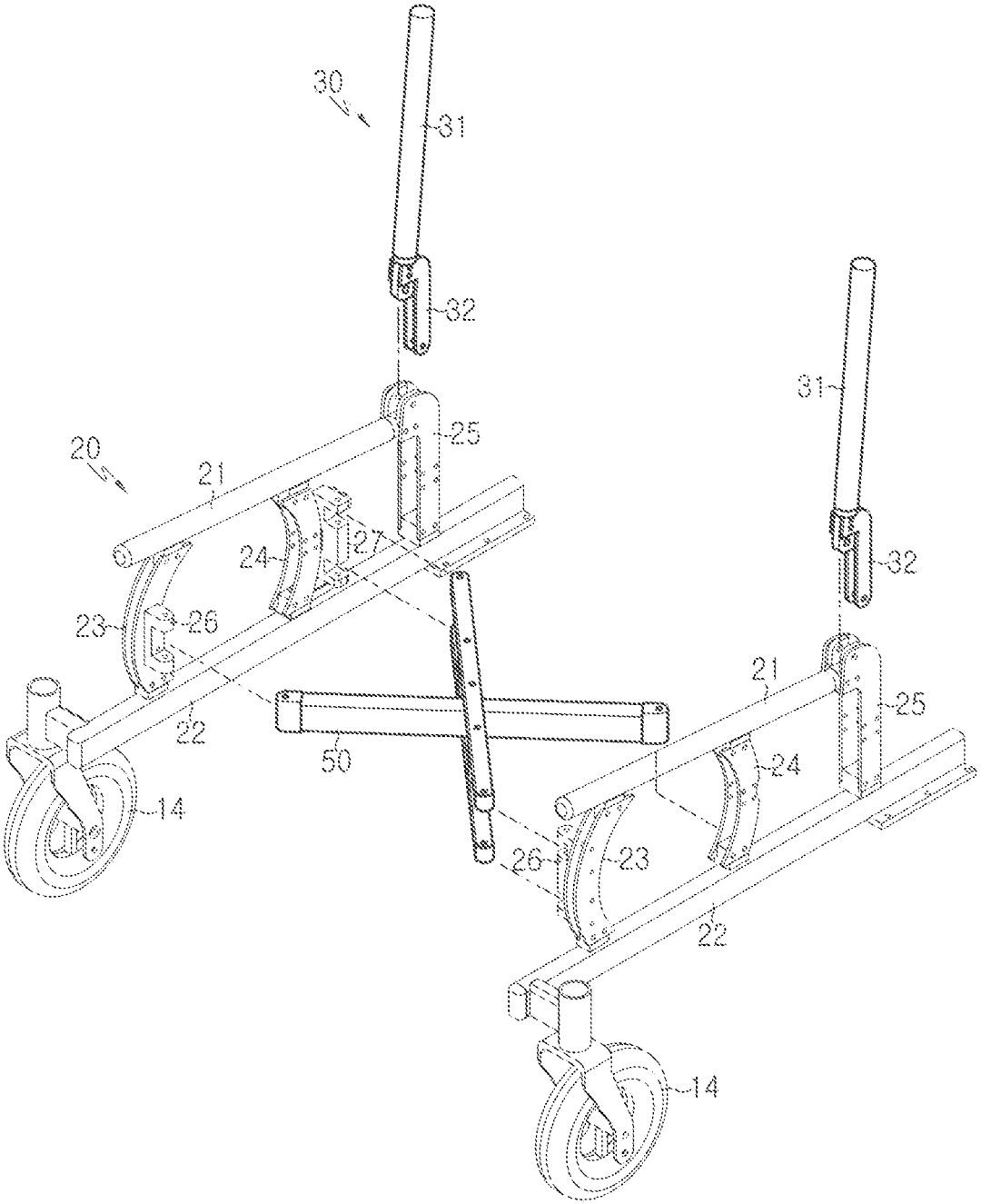
FIG. 4 is an exploded perspective view of the backrest interlocking type frame for a foldable wheelchair according to the present invention.

FIG. 3 is a perspective view of a backrest interlocking type frame for a foldable wheelchair according to the present invention, and FIG. 4 is an exploded perspective view of the backrest interlocking type frame for a foldable wheelchair according to the present invention.

As illustrated in FIG. 3, the backrest interlocking type frame for a foldable wheelchair according to the present invention includes a seat frame 20 having the easily foldable seat 11, and a horizontally foldable frame 50 is mounted below the seat frame 20. A backrest frame 30 on which an easily foldable backrest 12 is mounted at the back of the seat frame 20. When a user folds the backrest frame 30 in the direction of the arrow ①, the overall height and width of the wheelchair are folded at the same time while the horizontally foldable frame 50 is folded in the direction of the arrow ②, thereby reducing the volume of the wheelchair conveniently.

That is, as illustrated in the exploded perspective view of FIG. 4, the seat frame 20 includes a first horizontal bar 21 and a second horizontal bar 22 spaced apart from each other at a predetermined interval and respectively arranged at the top and bottom of the seat frame 20, and a first mounting member 23, a second mounting member 24 and a third mounting member 25 mounted between the first horizontal bar 21 and the second horizontal bar 22 and spaced apart from one another at predetermined intervals, wherein a driven wheel 14 is mounted at one side of the second horizontal bar 22 and a drive wheel 13 is mounted at the other side of the second horizontal bar 22. Two seat frames 20 are mounted by the medium of the horizontally foldable frame 50 in pair.

A first bracket 26 is mounted on the first mounting member 23 of each seat frame 20 so that one end of the horizontally foldable frame 50 is mounted rotatably, and a second bracket 27 is mounted on the second mounting member 24 of each seat frame 20 so that the other end of the horizontally foldable frame 50 is mounted rotatably. Accordingly, the overall width of the wheelchair is folded by the operation of the horizontally foldable frame 50.

Furthermore, the backrest frame 30 is rotatably mounted on the third mounting member 25 of the seat frame 20, so that the overall height of the wheelchair is folded according to the operation of the rotatable backrest frame 30. So, the present invention is configured such that the horizontally foldable frame 50 is operated interlocking with the operation of the backrest frame 30, thereby folding the overall height and width of the wheelchair at the same time by one motion and reducing the volume of the wheelchair.

Figure 5:
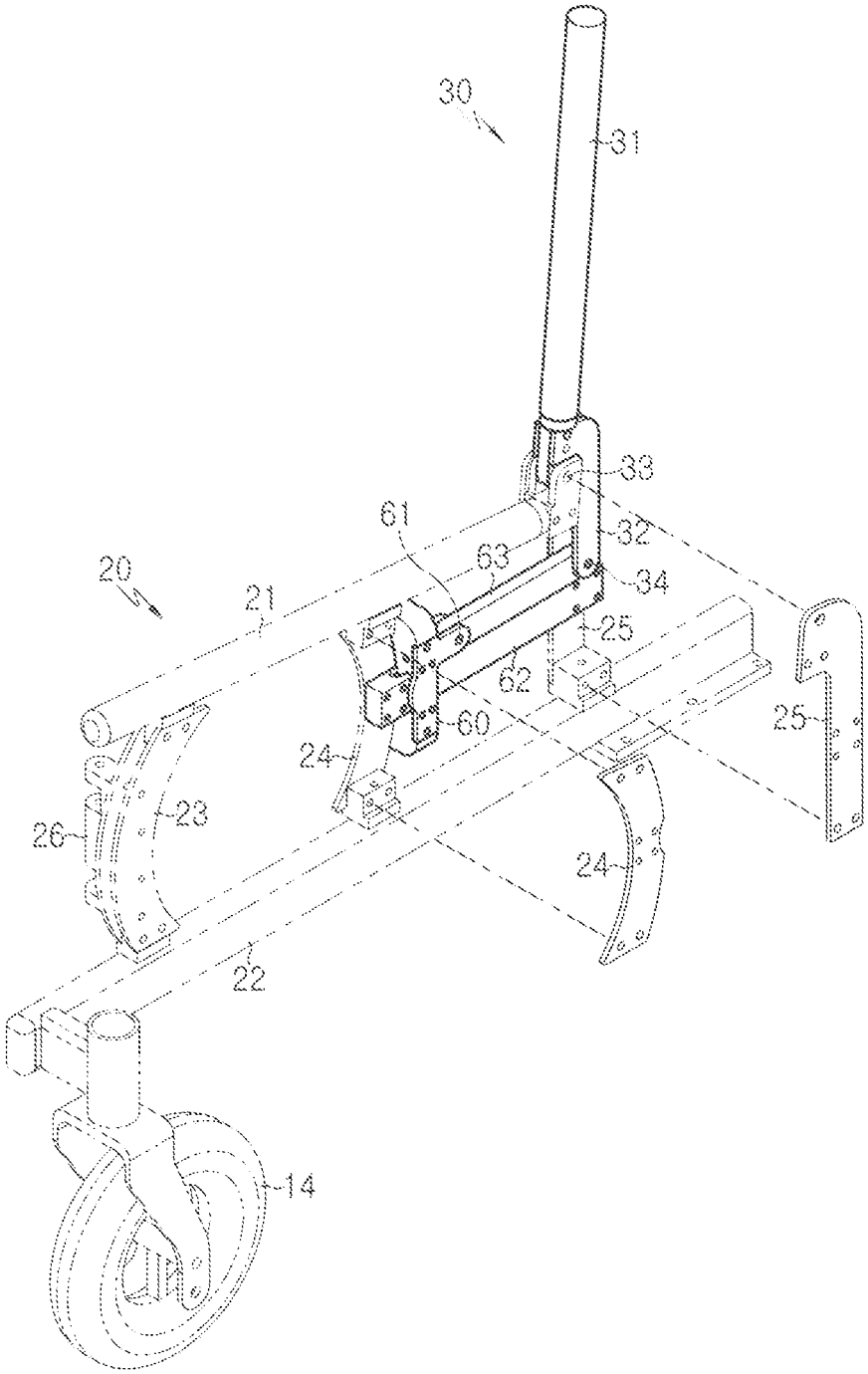
FIG. 5 is an exploded perspective view illustrating components for a backrest interlocking type operation of the present invention.
Figure 6:
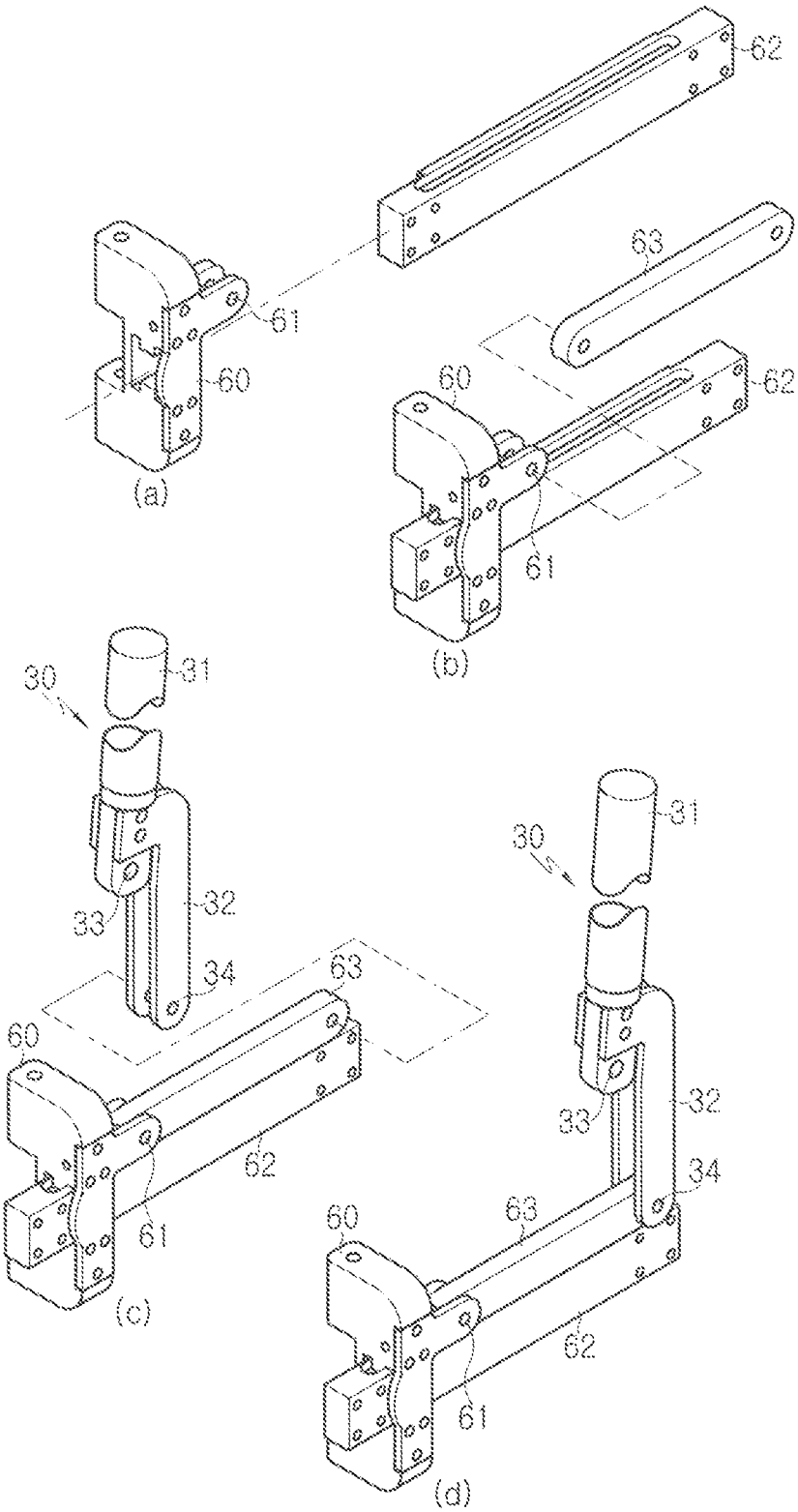
FIG. 6 is a perspective view illustrating a transfer block, a rail, a retractor, a first vertical bar, and a second vertical bar by assembly stages according to the present invention.

Referring to FIGS. 5 and 6, the one motion type configuration to fold the overall height and width of the wheelchair at the same time will be described. FIG. 5 is an exploded perspective view illustrating components for a backrest interlocking type operation of the present invention, and FIG. 6 is a perspective view illustrating a transfer block, a rail, a retractor, a first vertical bar, and a second vertical bar by assembly stages according to the present invention.

FIG. 5 illustrates components for a backrest interlocking type operation. One among a pair of the seat frames 20 is illustrated in the drawing, and so, configuration of the other seat frame 20 is the same, but just one seat frame 20 is illustrated for detailed description.

As illustrated in FIG. 5, both ends of a rail 62 are fixed between the second mounting member 24 and the third mounting member 25 of the seat frame 20, and a transfer block 60 moving along the rail 62 is mounted on the rail 62.

In addition, the backrest frame 30 has a first vertical bar 31 on which the backrest 12 is mounted, and a second vertical bar 32 formed integrally beneath the first vertical bar 31 to pull the retractor 63. One end of the first vertical bar 31 is rotatably mounted on the third mounting member 25 of the seat frame 20 through a first hinge portion 33.

Additionally, one end of the retractor 63 is rotatably mounted on the transfer block 60 through a third hinge portion 61, and the other end of the retractor 63 is rotatably mounted on the second vertical bar 32 of the backrest frame 30 through a second hinge portion 34.

More specifically, as illustrated in FIG. 6(*a*), the rail 62 fixedly installed between the second mounting member 24 and the second mounting member 25 of the seat frame 20 is provided, and the transfer block 60 passing through the rail 62 and moving along the rail 62 is provided.

As illustrated in FIG. 6(*b*), when the transfer block 60 is mounted on the rail 62, the bar-shaped retractor 63 is provided, and one end of the retractor 63 is rotatably mounted on the transfer block 60 through the third hinge portion 61.

In addition, as illustrated in FIG. 6(*c*), since the second vertical bar 32 of the backrest frame 30 is rotatably mounted on the other end of the retractor 63, so that the backrest frame 30, the transfer block 60, the rail 62, and the retractor 63 are assembled as illustrated in FIG. 6(*d*).

Figure 7:
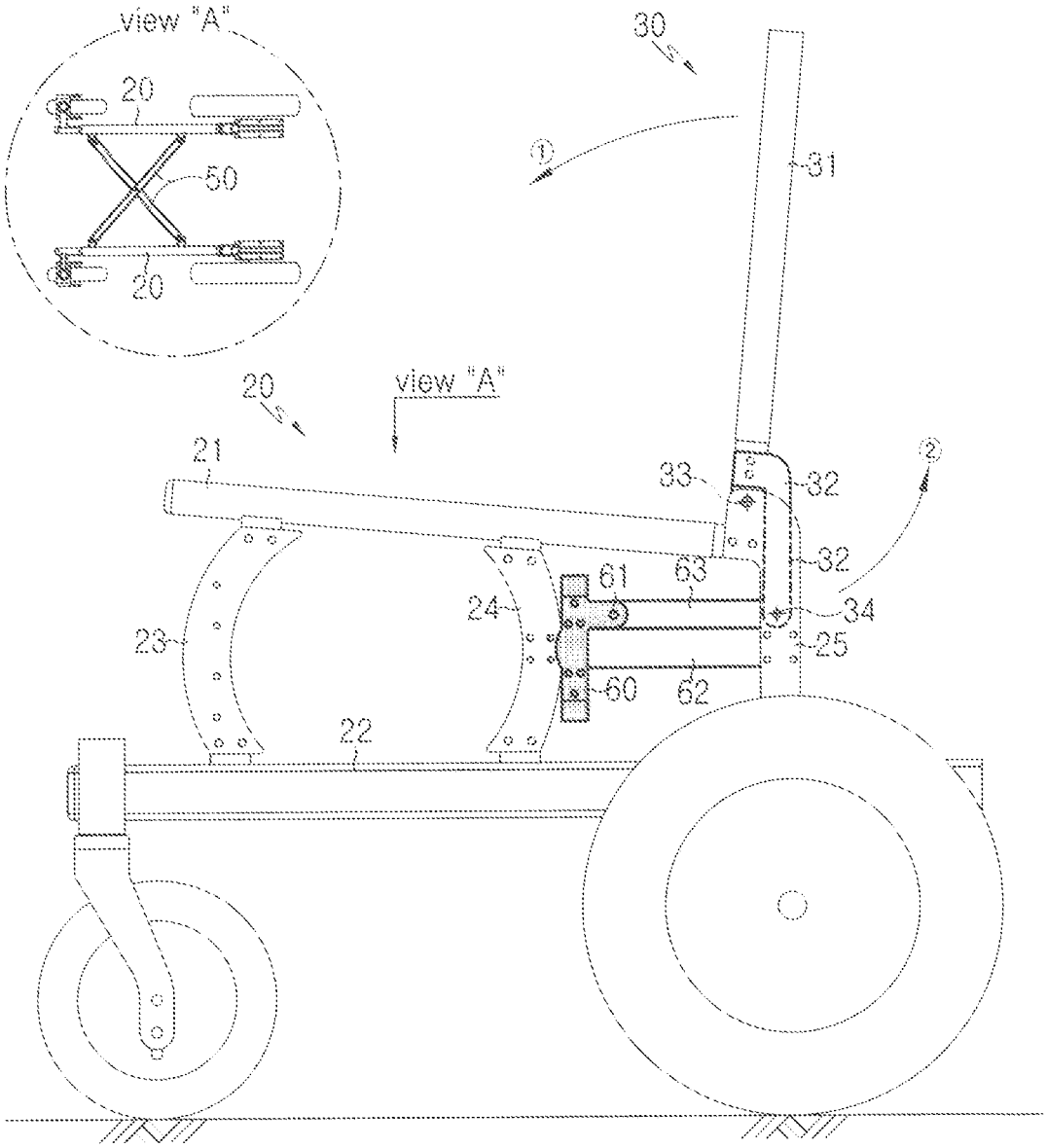
FIGS. 7 and 8 are side views illustrating the operation of the backrest interlocking type frame for a foldable wheelchair according to the present invention.
Figure 8:
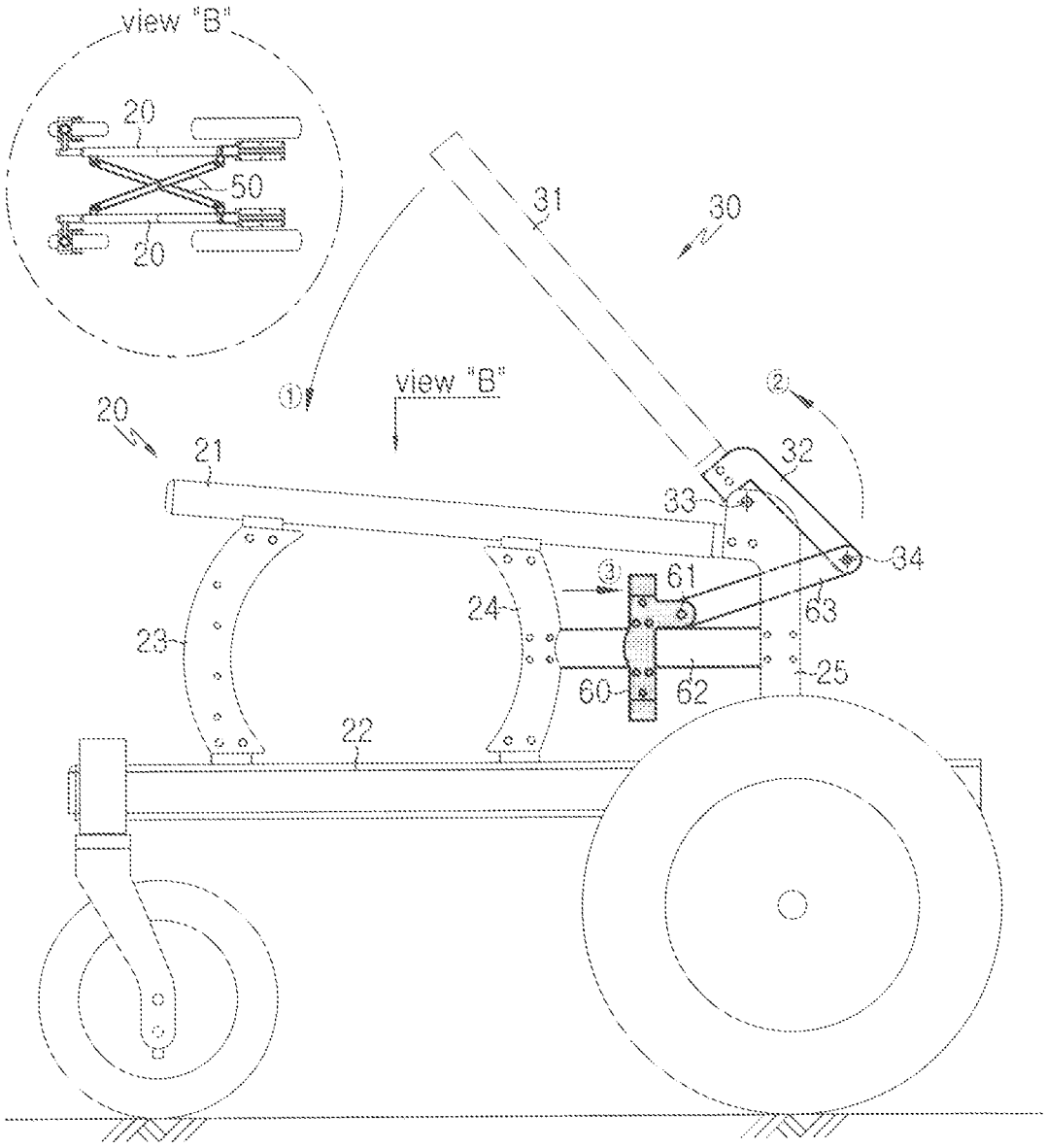
Figure 9:
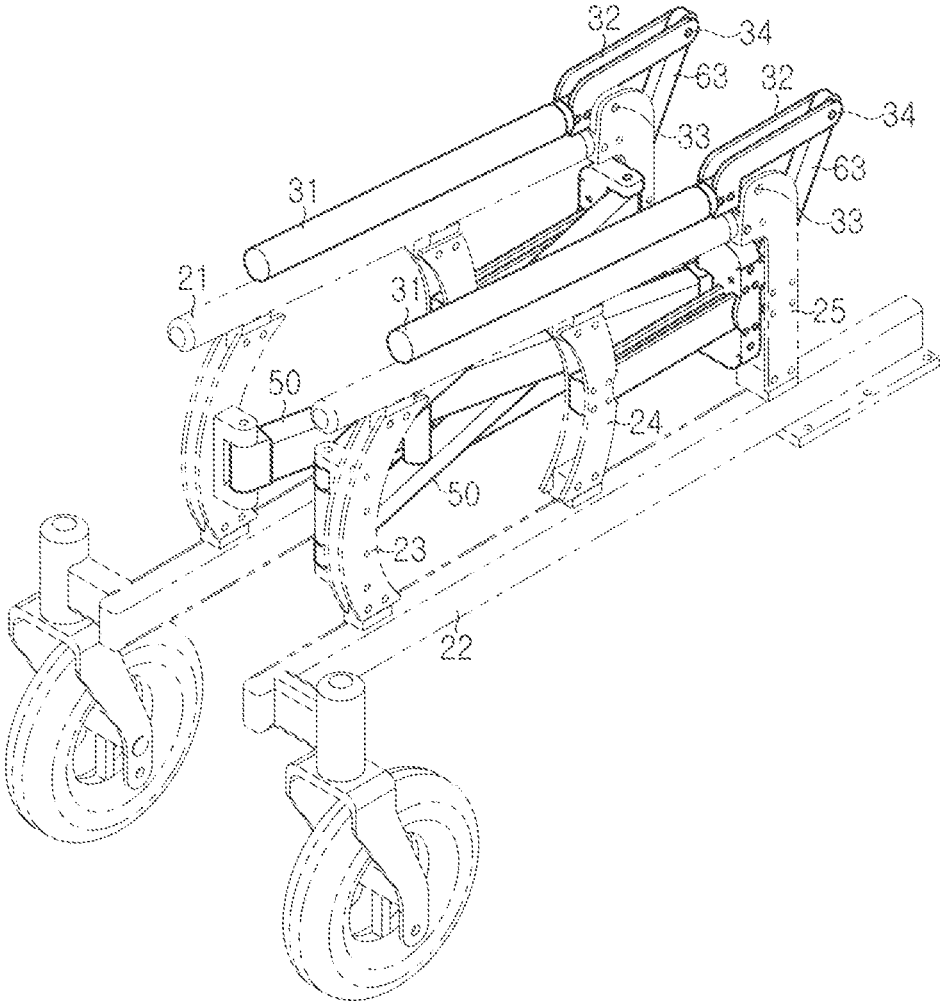
FIG. 9 is a perspective view illustrating a folded state of the backrest interlocking type frame for a foldable wheelchair according to the present invention.

FIGS. 7 and 8 are side views illustrating the operation of the backrest interlocking type frame for a foldable wheelchair according to the present invention, and FIG. 9 is a perspective view illustrating a folded state of the backrest interlocking type frame for a foldable wheelchair according to the present invention.

As illustrated in FIG. 7, when the first vertical bar 31 of the backrest frame 30 is rotated in the arrow direction ①, the second vertical bar 32 of the backrest frame 30 is rotated in the arrow direction ② around the first hinge portion 33.

As illustrated in FIG. 8, when the transfer block 60 is pulled while the retractor 63 is withdrawn from the third mounting member 25, the transfer block 60 moves in the arrow direction ③ along the rail 62.

As a result, as illustrated in FIGS. 7 and 8 briefly depicting that the overall height of the wheelchair is reduced while the backrest frame 30 is folded and briefly showing a plan view of the wheelchair, the overall width of the wheelchair while the width of the horizontally foldable frame 50 gets narrower, so that the volume of the wheelchair is considerably reduced by the one motion method as illustrated in FIG. 9.

As described above, the backrest interlocking type frame for the foldable wheelchair according to the present invention can simultaneously reduce the overall height and the overall width by just one motion to fold the backrest frame 30 when the wheelchair is not used, so that the overall volume of the wheelchair is remarkably reduced, thereby allowing the user to easily load and store the wheelchair.

What is claimed is:

1. A backrest interlocking type frame for a foldable wheelchair capable of simultaneously folding the overall height and width, comprising:

a seat frame which includes a first horizontal bar and a second horizontal bar spaced apart from each other at a predetermined interval and arranged at the top and the bottom of the seat frame, a first mounting member, a second mounting member, and a third mounting member mounted between the first horizontal bar and the second horizontal bar to be spaced apart from one another, a first bracket mounted on the first mounting member and a second bracket mounted on the second mounting member;

a backrest frame which includes a first vertical bar and a second vertical bar formed integrally, wherein one end of the first vertical bar is rotatably mounted on the third mounting member of the seat frame through a first hinge portion, and both ends of a rail are fixed between the second mounting member and the third mounting member of the seat frame;

a horizontally foldable frame rotatably mounted on the first bracket and the second bracket of the seat frame; and a transfer block mounted on the rail to move along the rail, wherein one end of a retractor is rotatably mounted on the transfer block through a third hinge portion, the other end of the retractor is rotatably mounted on the second vertical bar of the backrest frame through a second hinge portion, so that the horizontally foldable frame is operated to be folded when the backrest frame is folded downwardly, thereby reducing the overall width of the seat frame.

* * * * *